US012295513B2

(12) United States Patent
Tantisari

(10) Patent No.: US 12,295,513 B2
(45) Date of Patent: May 13, 2025

(54) SLEEPING PILLOW ASSEMBLY

(71) Applicant: Yulita Tantisari, Arcadia, CA (US)

(72) Inventor: Yulita Tantisari, Arcadia, CA (US)

( * ) Notice: Subject to any disclaimer, the term of this patent is extended or adjusted under 35 U.S.C. 154(b) by 273 days.

(21) Appl. No.: 17/973,900

(22) Filed: Oct. 26, 2022

(65) Prior Publication Data

US 2024/0138600 A1 May 2, 2024

(51) Int. Cl.
*A47G 9/10* (2006.01)

(52) U.S. Cl.
CPC ..... *A47G 9/10* (2013.01)

(58) Field of Classification Search
CPC .. A47G 9/10; A47G 2009/1018; A47G 9/109; A47G 9/1081; A47G 9/1072; A47G 9/1054; A47G 9/1063; A47C 20/027
See application file for complete search history.

(56) References Cited

U.S. PATENT DOCUMENTS 4,987,625 A * 1/1991 Edelson ..... A47C 20/026 D12/128
5,669,665 A * 9/1997 Nowak ..... B60N 2/2851 297/406
5,920,932 A * 7/1999 Hershgordon ..... A61F 5/56 5/636
6,671,906 B1 * 1/2004 Milligan ..... A47G 9/10 5/636
6,981,288 B1 * 1/2006 Hu ..... A47G 9/10 5/636
8,176,586 B2 5/2012 Berke
8,893,331 B2 11/2014 Cupo
9,730,537 B1 8/2017 Gilmore
9,943,179 B1 4/2018 May
D828,700 S 9/2018 Jhunjhnuwala
10,827,843 B2 11/2020 Miller
D939,245 S 12/2021 Medina
2004/0139550 A1 * 7/2004 Calagui ..... A47G 9/1009 5/636
2008/0163428 A1 * 7/2008 Groteke ..... A47G 9/109 5/636
2017/0238735 A1 8/2017 Millar

FOREIGN PATENT DOCUMENTS

WO WO-2012164109 A1 * 12/2012 ..... A47G 9/0253
WO WO2018112277 6/2018

* cited by examiner

*Primary Examiner* — Justin C Mikowski
*Assistant Examiner* — Alison N Labarge

(57) ABSTRACT

A sleeping pillow assembly for facilitating enhanced support and comfort while sleeping includes a central pillow that has a plurality of intersecting sides such that the central pillow has a rectangular shape to facilitate a user to rest their head and neck on the central pillow. A forward pillow is movably attached to the central pillow and forward pillow has a sloped surface which slopes downwardly from the central pillow to position the user's upper body at a preferred angle to enhance comfort and support for the user. A pair of side pillows is each movably attached to the central pillow. Each of the side pillows is positioned on opposite sides of the central pillow with respect to each other to support the user's head when the user sleeps on their side.

7 Claims, 6 Drawing Sheets

SLEEPING PILLOW ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pillow devices and more particularly pertains to a new pillow device for facilitating enhanced support and comfort while sleeping. The device includes a central pillow, a forward pillow attached to the central pillow and a pair of side pillows each attached to opposing sides of the central pillow. The forward pillow slopes downwardly from the central pillow to support a user's upper back when the user's head rests on the central pillow while sleeping. Each of the side pillows supports the user's head when the user rolls onto their side while sleeping.

(2) Description of Related Art Including Information Disclosed Under 37 CFR 1.97 and 1.98

The prior art relates to pillow devices including a sleeping pillow that has a concave upper surface to cradling a user's neck. The prior art discloses a sleeping pillow that has a notch in a front edge of the pillow to accommodate a user's neck. The prior art discloses a sleeping pillow that has a first pillow that is cigar shaped and a second pillow attached to the first pillow that has a wedge shape. The prior art discloses a sleeping pillow that includes a head pillow and a pair of body pillows each attached to and extending away from the head pillow such that the body pillows are oriented parallel to each other. The prior art discloses a sleeping pillow that includes a plurality of cushions that are spaced apart from each other. The prior art discloses an ornamental design for a sleeping pillow that includes a pillow and a pair of flaps disposed on top of the pillow. The prior art discloses an ornamental design for a sleeping pillow that includes a pair of pillows movably attached together and a central pillow extending upwardly from an intersection between the pair of pillows.

BRIEF SUMMARY OF THE INVENTION

An embodiment of the disclosure meets the needs presented above by generally comprising a central pillow that has a plurality of intersecting sides such that the central pillow has a rectangular shape to facilitate a user to rest their head and neck on the central pillow. A forward pillow is movably attached to the central pillow and forward pillow has a sloped surface which slopes downwardly from the central pillow to position the user's upper body at a preferred angle to enhance comfort and support for the user. A pair of side pillows is each movably attached to the central pillow. Each of the side pillows is positioned on opposite sides of the central pillow with respect to each other to support the user's head when the user sleeps on their side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
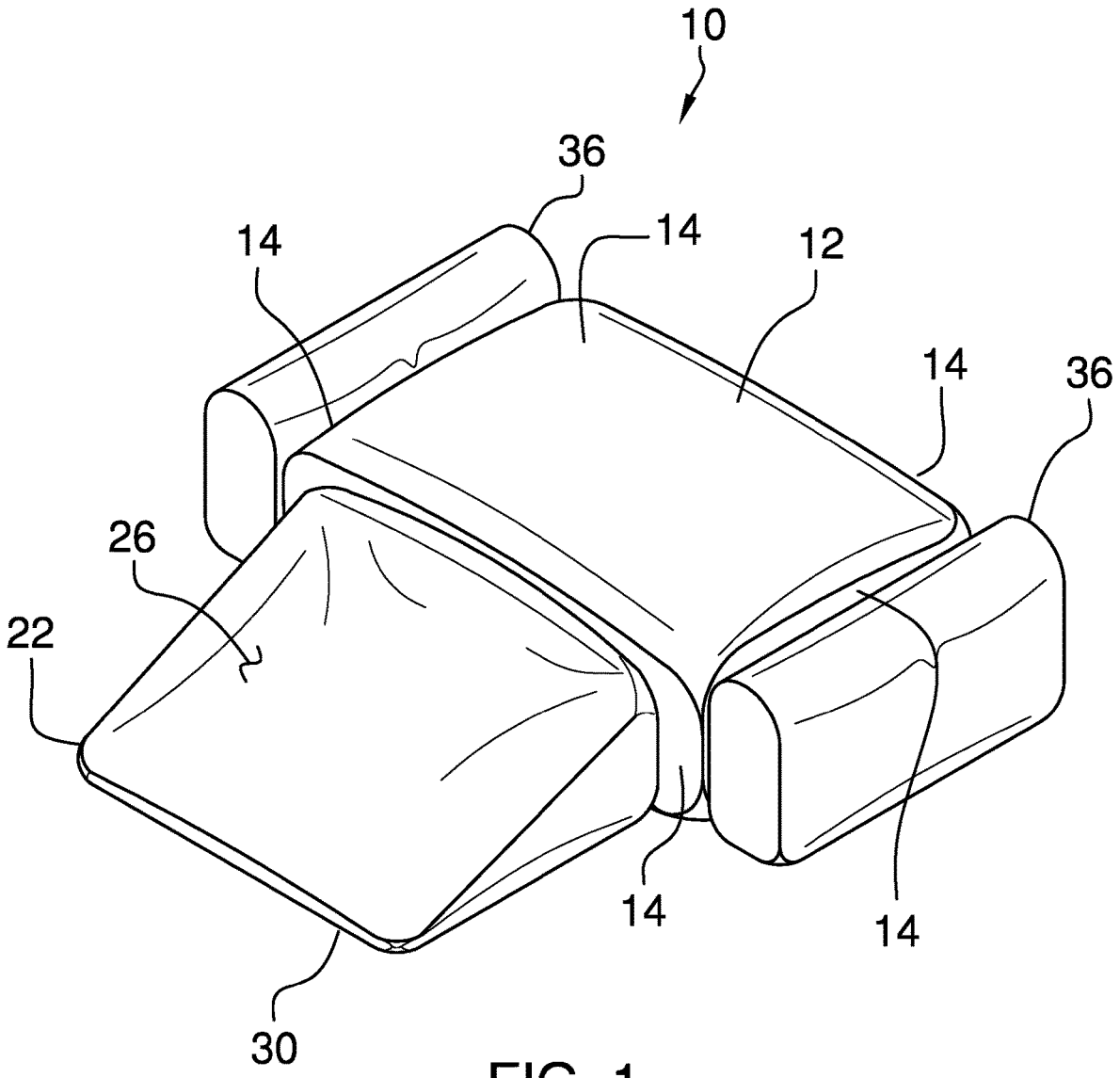
FIG. 1 is a top perspective view of a sleeping pillow assembly according to an embodiment of the disclosure.
Figure 2:
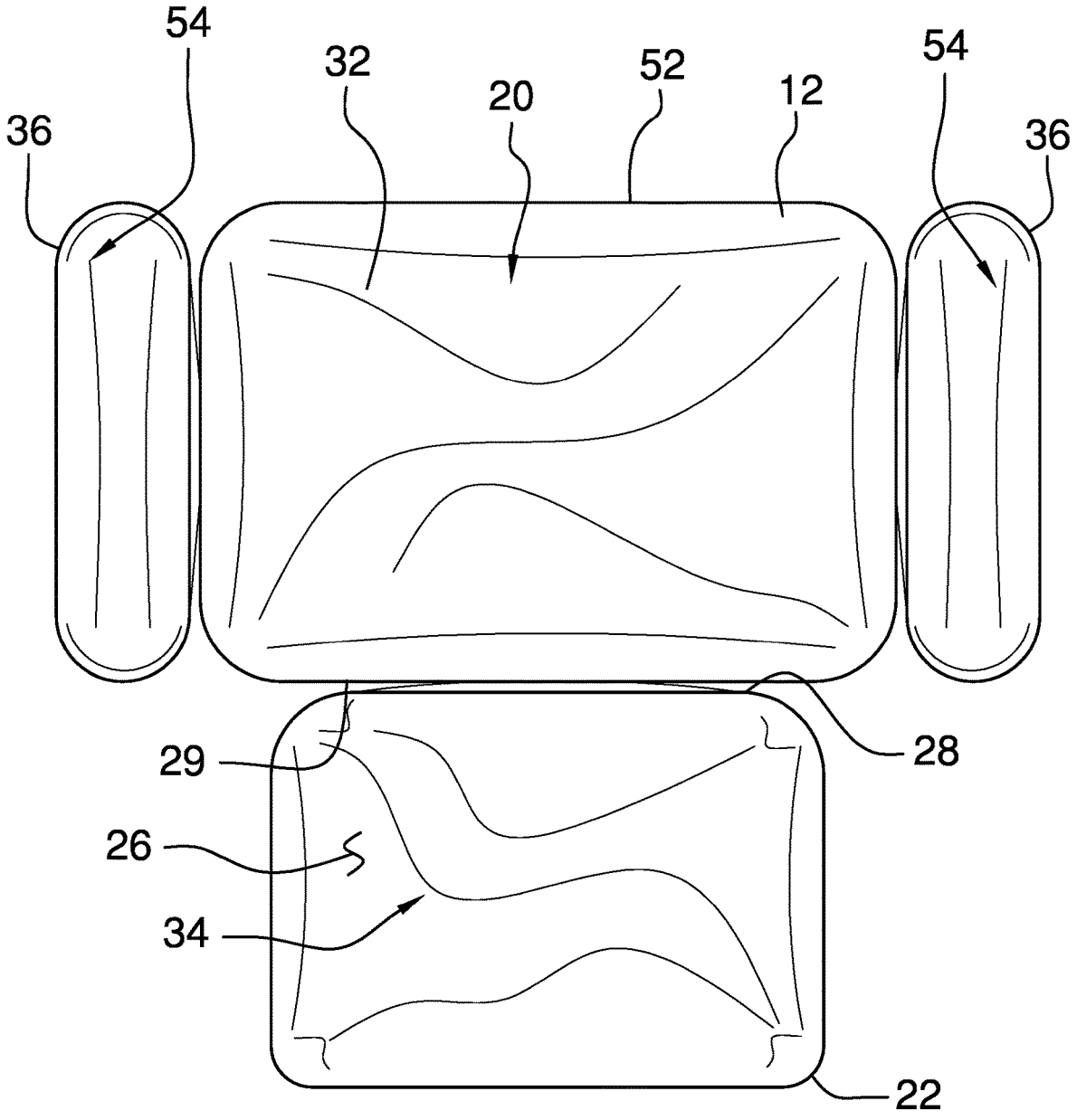
FIG. 2 is a top view of an embodiment of the disclosure.
Figure 3:
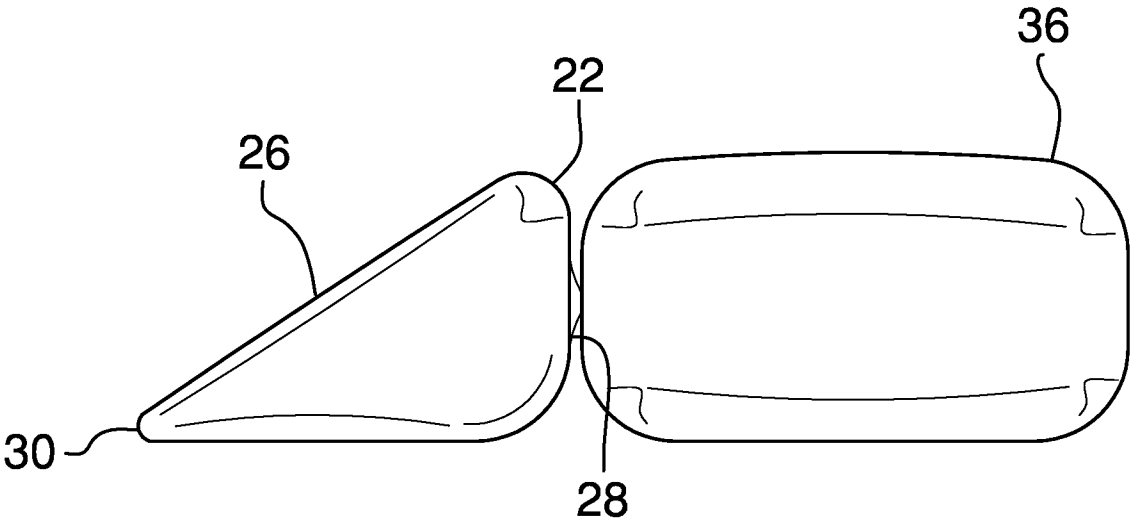
FIG. 3 is a left side view of an embodiment of the disclosure.
Figure 4:
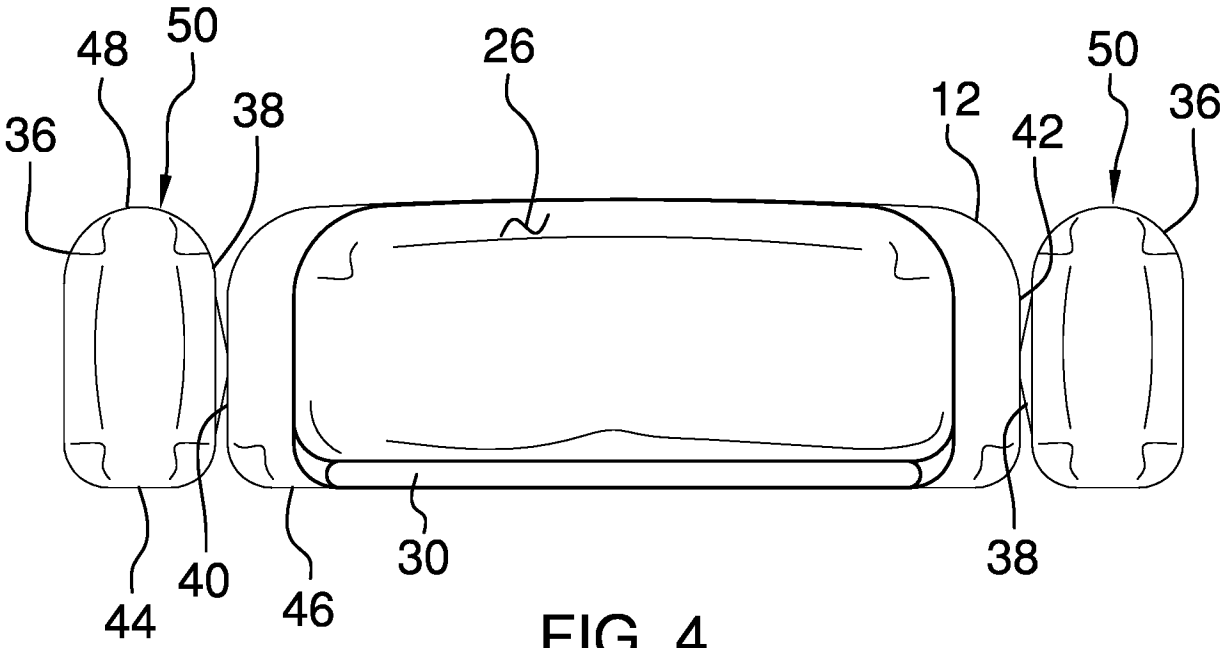
FIG. 4 is a front view of an embodiment of the disclosure.
Figure 5:
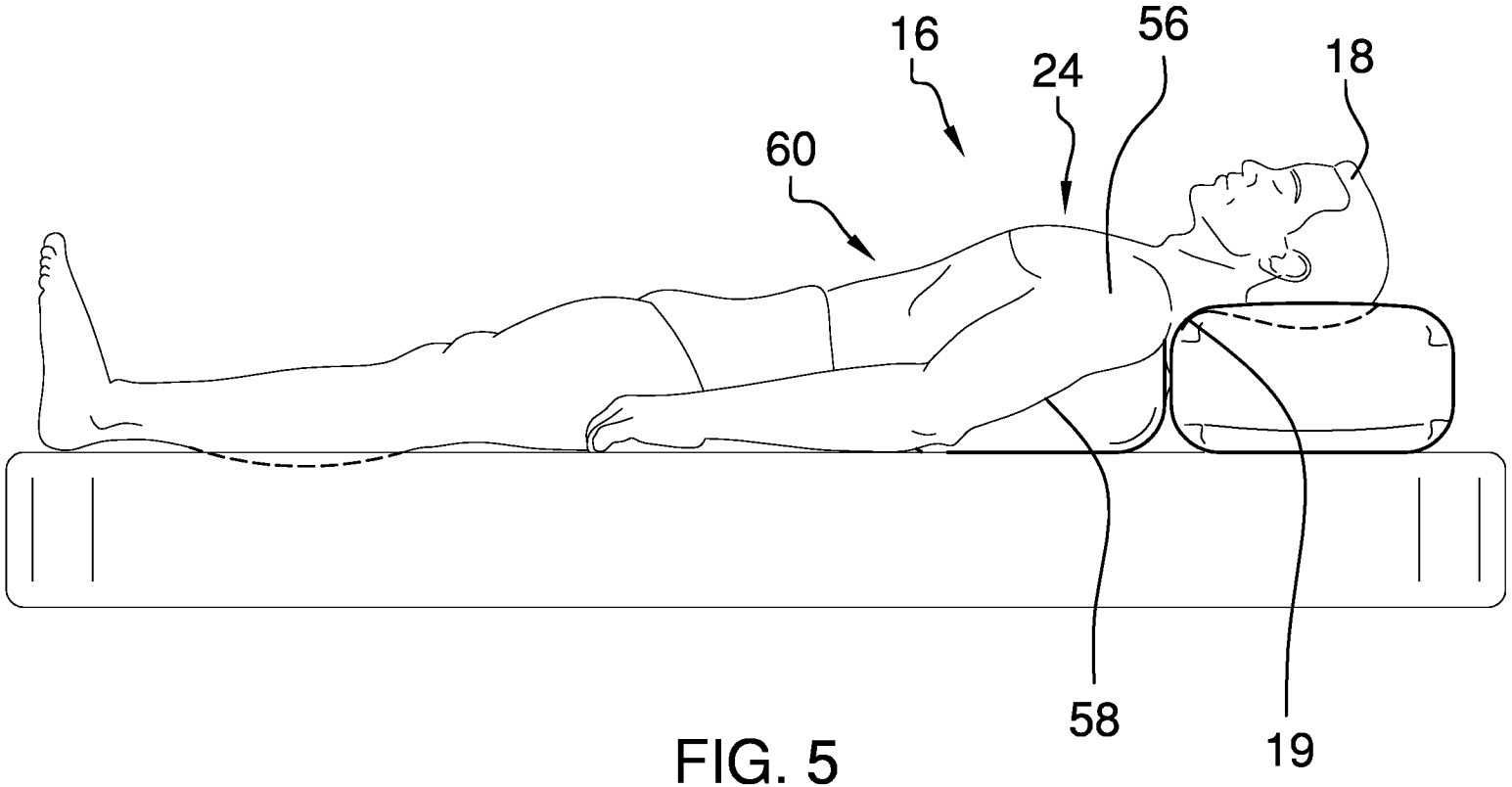
FIG. 5 is a perspective in-use view of an embodiment of the disclosure.
Figure 6:
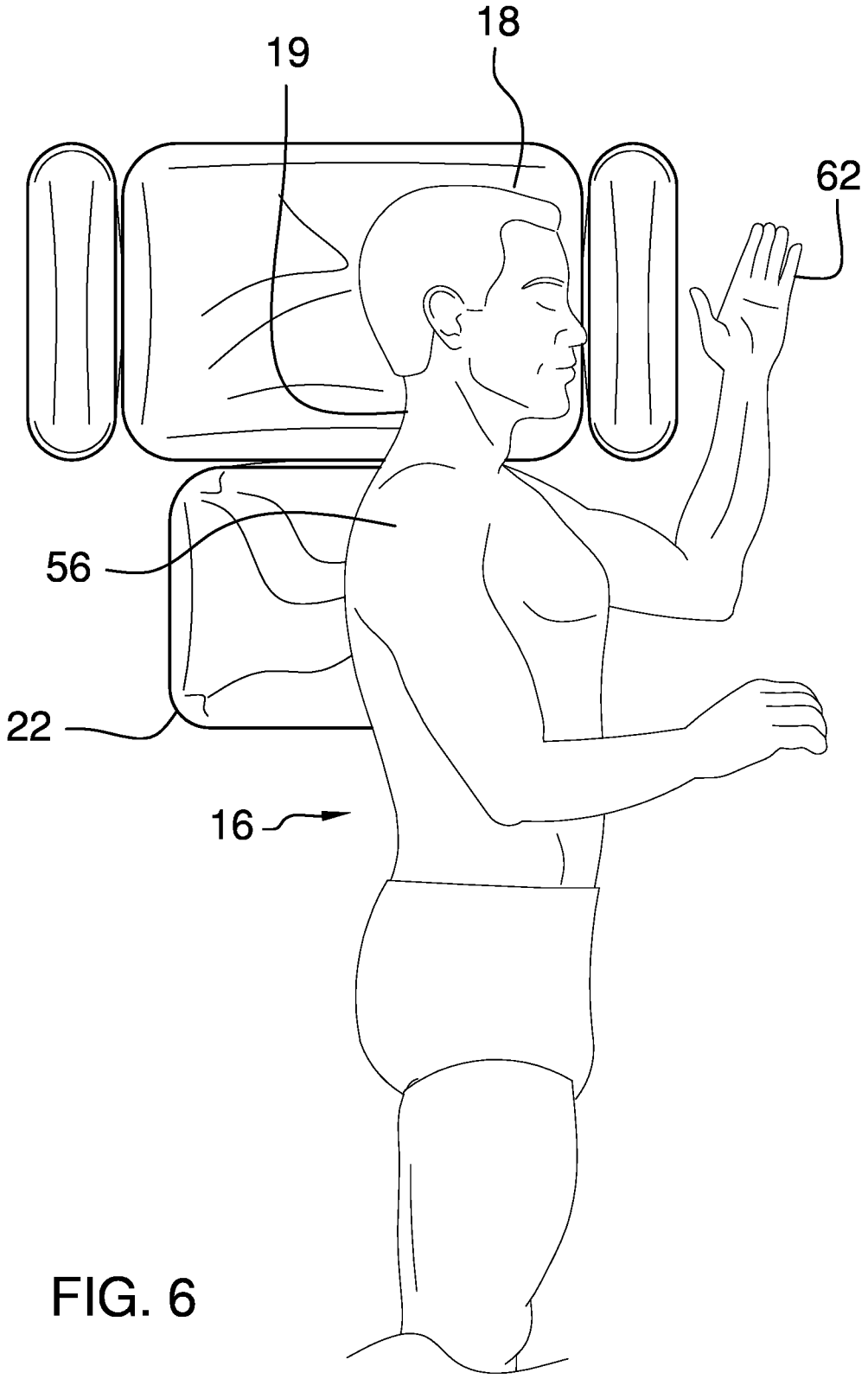
FIG. 6 is a top in-use view of an embodiment of the disclosure.

With reference now to the drawings, and in particular to FIGS. 1 through 6 thereof, a new pillow device embodying the principles and concepts of an embodiment of the disclosure and generally designated by the reference numeral 10 will be described.

As best illustrated in FIGS. 1 through 6, the sleeping pillow assembly 10 generally comprises a central pillow 12 has a plurality of intersecting sides 14 such that the central pillow 12 has a rectangular shape to facilitate a user 16 to rest their head 18 and neck 19 on the central pillow 12. Each of the intersecting sides 14 is perpendicularly oriented with respect to each other and the central pillow 12 is comprised of a resiliently compressible material to enhance comfort for the user 16. The resiliently compressible material may comprise foamed rubber, latex, polyfil or other type of hypo-allergenic material that not only enhances comfort for the user 16 but will also not induce an allergic reaction in the user 16. Additionally, the central pillow 12 includes a cover 20 surrounding the central pillow 12 and the cover 20 may be comprised of cotton, nylon or other type of flexible textile.

A forward pillow 22 is movably attached to and extends away from the central pillow 12 to facilitate the user 16 to rest their upper body 24 on the forward pillow 22. The forward pillow 22 has a sloped surface 26 which slopes downwardly from the central pillow 12 to position the user's upper body 24 at a preferred angle to enhance comfort for the user 16. The forward pillow 22 has a rear surface 28 that is attached to a front side 29 of the intersecting sides 14 of the central pillow 12. Additionally, the sloped surface 26 intersects the rear surface 28 and slopes downwardly from the rear surface 28 toward a distal end 30 of the forward pillow 22 with respect to the central pillow 12. The rear surface 28 has a height that is equal to a height of the front side 29 of the intersecting sides 14 of the central pillow 12 such that an intersection between the sloped surface 26 and the rear surface 28 is aligned with a top side 32 of the intersecting sides 14 of the central pillow 12. The sloped surface 26 of the forward pillow 22 has a width that is less than a width of the top side 32 of the intersecting sides 14 of the central pillow 12.

The forward pillow 22 has a cover 34 surrounding the forward pillow 22 and the cover 34 of the forward pillow 22 is attached to the cover of the central pillow 12 such that the forward pillow 22 is movably attached to the central pillow 12. Additionally, the cover 34 on the forward pillow 22 may be comprised of cotton, nylon or other type of flexible textile. The forward pillow 22 is comprised of a resiliently compressible material to enhance comfort for the user 16. The resiliently compressible material may comprise foamed rubber, latex, polyfil or other type of hypo-allergenic material that not only enhances comfort for the user 16 but will also not induce an allergic reaction in the user 16.

A pair of side pillows 36 is provided and each of the side pillows 36 is movably attached to the central pillow 12. Each of the side pillows 36 is positioned on opposite sides of the central pillow 12 with respect to each other to support the user's head 18 when the user 16 sleeps on their side. Each of the side pillows 36 has a lateral side 38 that is movably attached to a respective one of a first lateral side 40 and a second lateral side 42 of the intersecting sides 14 of the central pillow 12. Each of the side pillows 36 has a lower side 44 that is flattened and the lower side 44 of each of the side pillows 36 is aligned with a bottom side 46 of the intersecting sides 14 of the central pillow 12. Each of the side pillows 36 has an upper side 48 curving upwardly to facilitate effective lateral surface and to enhance comfort for the user 16 and an apex 50 of the upper side 48 of each of the side pillows 36 is aligned with the top side 32 of the intersecting sides 14 of the central pillow 12. Each of the side pillows 36 extends between the front side 29 and a back side 52 of the intersecting sides 14 of the central pillow 12.

Each of the side pillows 36 has a cover 54 that is attached to the cover 20 surrounding the central pillow 12 such that the side pillows 36 are movably attached to the central pillow 12. Additionally, the cover 54 on each of the side pillows 36 may be comprised of cotton, nylon or other type of flexible textile. The side pillows 36 are each comprised of a resiliently compressible material to enhance comfort for the user 16. The resiliently compressible material may comprise foamed rubber, latex, polyfil or other type of hypo-allergenic material that not only enhances comfort for the user 16 but will also not induce an allergic reaction in the user 16.

In use, the user 16 places their head 18 and neck on the central pillow 12 and the user 16 places their shoulders 56 and upper back 58 on the forward pillow 22 when the user 16 is sleeping. In this way the central pillow 12 and the forward pillow 22 positions the user's body 60 in an optimum position to for support and comfort thereby reducing muscle tightness and pain that can often result from improper posture while sleeping. Furthermore, the central pillow 12 and the forward pillow 22 facilitate the user's body 60 to be positioned in an optimum support and comfort position when the user 16 sleeps on their side rather than on their back. Additionally, a respective one of the user's shoulders 56 can slide between the central pillow 12 and a respective side pillow 36 when the user sleeps on their side. In this way the central pillow 12, the forward pillow 22 and the side pillows 36 enhance comfort and support for the user 16 thereby enhancing the quality of sleep for the user 16 regardless of how the user 16 positions themselves while sleeping. The side pillows 36 support the central pillow 12 to inhibit the central pillow 12 from becoming flattened and to support the user's head 18 and neck 19 when the user 16 is sleeping on their side. Furthermore, the side pillows 36 inhibit the user 16 from sliding their hands 62 beneath the central pillow 12 thereby reducing numbness and discomfort that can result from the user 16 placing their hands 62 beneath the central pillow 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sleeping pillow assembly for enhancing comfort for a user to sleep in a variety of positions, said assembly comprising:

a central pillow having a plurality of intersecting sides such that said central pillow has a rectangular shape wherein said central pillow is configured to facilitate a user to rest their head and neck on said central pillow;

a forward pillow being movably attached to and extending away from said central pillow wherein said forward pillow is configured to facilitate the user to rest their upper body on said forward pillow, said forward pillow having a planar surface which slopes downwardly from said central pillow wherein said planar sloped surface is configured to position the user's upper body at a preferred angle to enhance comfort and support for the user;

a pair of side pillows, each of said side pillows being movably attached to said central pillow, each of said side pillows being positioned on opposite sides of said central pillow with respect to each other wherein a respective one of said side pillows is configured to support the user's head when the user sleeps on their side;

wherein each of said intersecting sides of said central pillow is perpendicularly oriented with respect to each other; and wherein said forward pillow has a rear surface being attached to a front side of said intersecting sides of said central pillow, said sloped surface intersecting said rear surface and sloping downwardly from said rear surface toward a distal end of said forward pillow with respect to said central pillow, wherein said rear surface has a height being equal to a height of said front side of said intersecting sides of said central pillow such that an intersection between said planar sloped surface and said rear surface is aligned with a top side of said intersecting sides of said central pillow; and wherein said planar sloped surface of said forward pillow has a width being less than a width of a top side of said intersecting sides of said central pillow.

2. The assembly according to claim 1, wherein:

said central pillow includes a cover surrounding said central pillow; and said forward pillow has a cover surrounding said forward pillow, said cover of said forward pillow being attached to said cover of said central pillow such that said forward pillow is movably attached to said central pillow.

3. The assembly according to claim 1, wherein each of said side pillows has a lateral side being movably attached to a respective one of a first lateral side and a second lateral side of said intersecting sides of said central pillow.

4. The assembly according to claim 1, wherein:

each of said side pillows has a lower side being flattened, said lower side of each of said side pillows being aligned with a bottom side of said intersecting sides of said central pillow; and each of said side pillows has an upper side curving upwardly wherein said upper side of each of said side pillows is configured to facilitate effective lateral support and enhance comfort for the user, an apex of said upper side of each of said side pillows being aligned with said top side of said intersecting sides of said central pillow.

5. The assembly according to claim 1, wherein each of said side pillows extends between a front side and a back side of said intersecting sides of said central pillow.

6. The assembly according to claim 1, wherein:

said central pillow includes a cover surrounding said central pillow; and each of said side pillows has a cover being attached to said cover surrounding said central pillow.

7. A sleeping pillow assembly for enhancing comfort for a user to sleep in a variety of positions, said assembly comprising:

a central pillow having a plurality of intersecting sides such that said central pillow has a rectangular shape wherein said central pillow is configured to facilitate a user to rest their head and neck on said central pillow, each of said intersecting sides being perpendicularly oriented with respect to each other, said central pillow being comprised of a resiliently compressible material wherein said central pillow is configured to enhance comfort for the user, said central pillow including a cover surrounding said central pillow;

a forward pillow being movably attached to and extending away from said central pillow wherein said forward pillow is configured to facilitate the user to rest their upper body on said forward pillow, said forward pillow having a planar sloped surface which slopes downwardly from said central pillow wherein said planar sloped surface is configured to position the user's upper body at a preferred angle to enhance comfort and support for the user, said forward pillow being comprised of a resiliently compressible material for enhancing comfort for the user, said forward pillow having a rear surface being attached to a front side of said intersecting sides of said central pillow, said planar sloped surface intersecting said rear surface and sloping downwardly from said rear surface toward a distal end of said forward pillow with respect to said central pillow, said rear surface having a height being equal to a height of said front side of said intersecting sides of said central pillow such that an intersection between said planar sloped surface and said rear surface is aligned with a top side of said intersecting sides of said central pillow, said forward pillow having a cover surrounding said forward pillow, said cover of said forward pillow being attached to said cover of said central pillow such that said forward pillow is movably attached to said central pillow, said planar sloped surface of said forward pillow having a width being less than a width of said top side of said intersecting sides of said central pillow; and a pair of side pillows, each of said side pillows being movably attached to said central pillow, each of said side pillows being positioned on opposite sides of said central pillow with respect to each other wherein a respective one of said side pillows is configured to support the user's head when the user sleeps on their side, each of said side pillows being comprised of a resiliently compressible material wherein each of said side pillows is configured to enhance comfort for the user, each of said side pillows having a lateral side being movably attached to a respective one of a first lateral side and a second lateral side of said intersecting sides of said central pillow, each of said side pillows having a lower side being flattened, said lower side of each of said side pillows being aligned with a bottom side of said intersecting sides of said central pillow, each of said side pillows having an upper side curving upwardly wherein said upper side of each of said side pillows is configured to facilitate effective lateral support and enhance comfort for the user, an apex of said upper side of each of said side pillows being aligned with said top side of said intersecting sides of said central pillow, each of said side pillows extending between said front side and a back side of said intersecting sides of said central pillow, each of said side pillows having a cover being attached to said cover surrounding said central pillow.

* * * * *